US010632592B2

(12) United States Patent
Weber et al.

(10) Patent No.: US 10,632,592 B2
(45) Date of Patent: Apr. 28, 2020

(54) QUICK CLAMP PIPE VISE AND METHOD

(71) Applicant: JPW Industries Inc., LaVergne, TN (US)

(72) Inventors: Charles Weber, Onalaska, WI (US); Thomas Balko, La Crosse, WI (US); Benjamin Carlson, Holmen, WI (US); Joseph Galluzzi, Nashville, TN (US); Adam Brown, Nolensville, TN (US)

(73) Assignee: JPW Industries Inc., LaVergne, TN (US)

( * ) Notice: Subject to any disclaimer, the term of this patent is extended or adjusted under 35 U.S.C. 154(b) by 121 days.

(21) Appl. No.: 15/865,486

(22) Filed: Jan. 9, 2018

(65) Prior Publication Data

US 2018/0193982 A1 Jul. 12, 2018

Related U.S. Application Data

(60) Provisional application No. 62/444,890, filed on Jan. 11, 2017.

(51) Int. Cl.
*B25B 1/00* (2006.01)
*B25B 1/20* (2006.01)
(Continued)

(52) U.S. Cl.
CPC ..... *B25B 1/20* (2013.01); *B25B 1/02* (2013.01); *B25B 1/08* (2013.01); *B25B 1/22* (2013.01); *B25B 1/2405* (2013.01); *B25B 1/2484* (2013.01); *B25B 5/006* (2013.01); *B25B 5/085* (2013.01); *B25B 5/163* (2013.01); *B25H 1/06* (2013.01); *B25H 1/08* (2013.01); *B25H 1/12* (2013.01); *B25H 3/06* (2013.01)

(58) Field of Classification Search
CPC .... B25B 1/20; B25B 1/02; B25B 1/22; B25B 5/085; B25B 1/2405
See application file for complete search history.

(56) References Cited

U.S. PATENT DOCUMENTS 2,005,162 A 6/1935 Petersen
3,863,945 A 2/1975 Dunstan
(Continued)

FOREIGN PATENT DOCUMENTS

AU 5789380 5/1979
GB 2292537 A 2/1996

OTHER PUBLICATIONS

PCT/US2018/013132 Preliminary Report on Patentability and Written Opinion, dated Jul. 26, 2019, nine pages.

*Primary Examiner* — Lee D Wilson
(74) *Attorney, Agent, or Firm* — Waller Lansden Dortch & Davis, LLP; Blake M. Bernard

(57) ABSTRACT

A pipe clamp has a base with a fixed jaw and a beam extending from the base. A movable jaw member is slidably mounted on the beam. The movable jaw member includes a movable jaw disposed opposite the fixed jaw. A pivotable handle is mounted to the movable jaw member and a clamping mechanism is connected to the pivotable handle and operated by the pivotable handle to move the movable jaw relative to the fixed jaw. A latch secures the pivotable handle in any of a plurality of positions. A tripod stand may be provided for supporting the pipe clamp, the tripod having a multi-compartment storage spreader.

20 Claims, 10 Drawing Sheets

(51) Int. Cl.

| | |
|---|---|
| ***B25B 1/24*** | (2006.01) |
| ***B25B 1/02*** | (2006.01) |
| ***B25H 1/12*** | (2006.01) |
| ***B25B 1/22*** | (2006.01) |
| ***B25B 1/08*** | (2006.01) |
| ***B25H 1/08*** | (2006.01) |
| ***B25B 5/08*** | (2006.01) |
| ***B25B 5/00*** | (2006.01) |
| ***B25H 3/06*** | (2006.01) |
| ***B25B 5/16*** | (2006.01) |
| ***B25H 1/06*** | (2006.01) |

(56) References Cited

U.S. PATENT DOCUMENTS

| | | | | |
|---|---|---|---|---|
| 4,349,931 | A * | 9/1982 | Leon | B23G 1/52 269/131 |
| 6,089,554 | A * | 7/2000 | Berardino | B25B 5/006 269/130 |
| 8,777,205 | B2 | 7/2014 | Hamm et al. | |
| 8,967,606 | B2 * | 3/2015 | Hamm | B25H 1/06 269/130 |
| 2012/0175833 | A1 * | 7/2012 | Hamm | B25B 1/205 269/266 |
| 2012/0175834 | A1 * | 7/2012 | Hamm | B23K 37/006 269/293 |
| 2013/0333281 | A1 | 12/2013 | Donitz | |
| 2018/0193982 | A1 * | 7/2018 | Weber | B25B 1/22 |

* cited by examiner

QUICK CLAMP PIPE VISE AND METHOD

CROSS-REFERENCE TO RELATED APPLICATION

The present application claims the benefit of U.S. Provisional Patent Application Ser. No. 62/444,890, filed Jan. 11, 2017, which is incorporated herein by reference.

BACKGROUND

Field

The present invention relates generally to a clamp or vise and method for clamping, and more particularly to a pipe vise or clamp and method for holding pipes and other objects against a base.

Description of the Related Art

Pipe vises or clamps are used by plumbers, electricians, and others to hold pipes, conduit, tubes, beams, cylindrical and oblong materials, flat materials, and other items. The pipe vises or clamps may hold a pipe or other item for cutting, thread forming, joining, bending, shaping, assembly, disassembly, or other actions.

An example of a chain vise pipe clamp 10 is shown in FIG. 1. The chain vise 10 includes a roller chain 12 similar to a bicycle chain, that is tightened by a crank 14 to hold a pipe against jaws 16 that are supported in a base 18. The base 18 includes a pipe rest 19 spaced from the jaws 16 to ensure that a pipe is positioned perpendicular to the jaws 16.

Another type of pipe clamp is a yoke vise pipe clamp 20 as shown in FIG. 2. The yoke pipe clamp 20 includes a handle 22 that is used to turn a threaded shaft 24 which moves a movable jaw 26 in a yoke 28. The movable jaw 26 holds a pipe 30 against a fixed jaw 32 in a base 34. The base 34 includes a pipe rest 35 spaced from the fixed jaw 32. The yoke 28 is secured to the base 34 by a pivot 36 and a hook 38.

SUMMARY

The present apparatus and method provides a clamp for holding a pipe or other object against a base. The clamp includes a handle that pivots to move a movable jaw toward or away from a fixed jaw on the base. The handle is connected to the movable jaw by a cam so that movement of the handle may exert pressure on the pipe or other object via the movable jaw. A latch secures the handle in predetermined positions, such as to maintain pressure on the pipe by the movable jaw and thus hold a pipe in the jaws. The latch is selectively releasable to permit opening of the jaws and release of the pipe. The movable jaw and handle are supported by a beam that is mounted in a base in which is provided the fixed jaw. The movable jaw and handle may be moved along the beam to accommodate different sizes of pipes or other objects to be held in the vise. A tripod or stand may be provided for the pipe vise.

DETAILED DESCRIPTION

Figure 1:
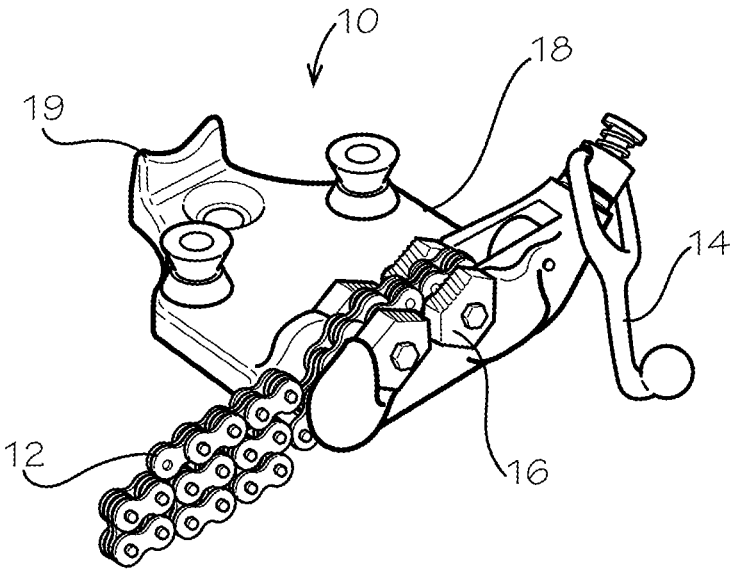
FIG. 1 is a perspective view of a chain vise pipe clamp of the prior art.
Figure 2:
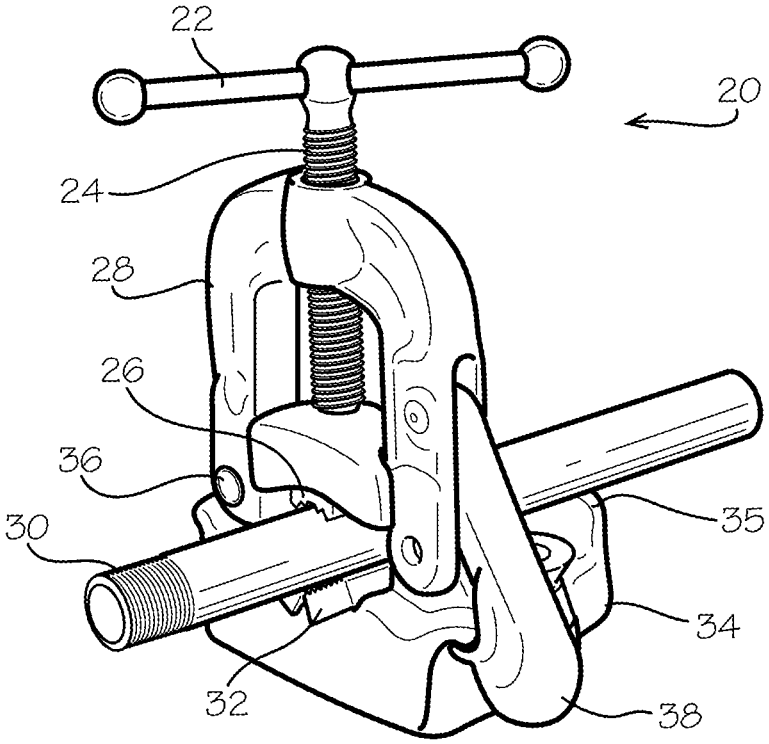
FIG. 2 is a perspective view of a yoke vise pipe clamp of the prior art.
Figure 3:
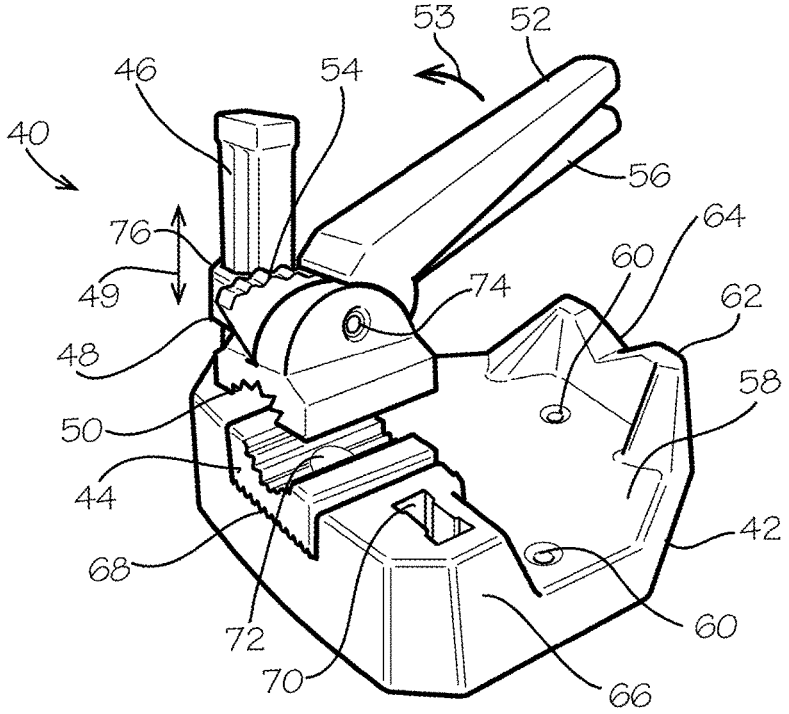
FIG. 3 is a perspective view of a first embodiment of a quick clamp pipe clamp according to the present apparatus and method.

In FIG. 3, a quick clamp pipe vise 40 includes a base 42 in which is mounted a fixed jaw 44 and a beam 46. A movable jaw member 48 is slidably mounted on the beam 46 as indicated by a double arrow 49. The movable jaw member 48 includes a movable jaw 50 and a handle 52. The handle 52 is mounted in the movable jaw member 48 for pivoting movement as indicated by an arrow 53 to open the movable jaw 50, and in a reverse direction of the arrow 53 to close the movable jaw 50. A catch mechanism 54 is provided on the movable jaw member 48 by which the handle 52 may be retained in one or more predetermined rotational positions. A release 56 that is operable to release the catch mechanism 54 is provided.

In particular, the base 42 is provided with a recessed area 58 in which is formed three holes 60 through which may be mounted bolts, screws or other fasteners for fastening the base to a workbench, truck bed, truck bumper, on a receiver hitch platform, on a stand, tripod, or other mounting location. A raised portion 62 with a notch 64 extends upwardly from the recessed area 58 to provide a pipe rest for aligning a pipe in the jaws 44 and 50. A second raised portion 66 includes a recess 68 for the fixed jaw 44 and two recesses 70 for the beam 46 on either side of the fixed jaw 44. The fixed jaw 44 is removable from the recess 68, and is held in place in the recess 68 by a releasable fastener 72 that extends through the fixed jaw 44 and into the base 42. The fixed jaw 44 is V-shaped with parallel ridges in the illustrated embodiment, although other shapes are possible. The movable jaw 50 has a similar shape to the fixed jaw, although this need not be true in every embodiment. The fixed jaw 44 may be in line with the pipe rest notch 64 so that a pipe or other extended object may be supported and/or aligned in the notch 64 when clamped in the jaws 44 and 50.

The movable jaw member 48 has a pivot 74 on which the handle 52 rotates. Rotation of the handle 52 moves the movable jaw 50 relative to a sleeve 76 that is mounted on the beam 46. The movable jaw 50 moves in a direction toward and away from the fixed jaw 44, depending on the direction of rotation of the handle 52, to apply or release a gripping or clamping force on a pipe or other object between the jaws 44 and 50. The catch mechanism 54 maintains the handle 52 and thus the movable jaw 50 in the desired position, for example to maintain gripping force on a pipe.

The sleeve 76 may be slid or otherwise moved along the beam 46 when no load or force is being exerted by the movable jaw member 48. The spacing between the fixed jaw 44 and the movable jaw 50 is readily adjustable to accommodate different size pipes or objects by sliding the sleeve 76 along the beam 46. When a force is exerted by the movable jaw 50 to grip a pipe or other object, the direction of the force is offset from the axis of the beam 46, applying a rotational force to the sleeve 76 and causing the sleeve 76 to engage the beam 46 and remain in position rather than sliding. A cantilever is formed by the movable jaw member 48 on the beam 46 as the gripping force is applied at an offset from the axis of the beam 46. The cantilever force or rotational force maintains the sleeve 76 in a position on the beam 46 and prevents sliding motion of the sleeve 76 on the beam 46 during application of the gripping force by the jaws 44 and 50. Once the jaw spacing is adjusted to accommodate a size of pipe, the clamping force on the pipe secures the sleeve in position.

Rotation or pivot movement of the handle 52 on the pivot 74 moves the movable jaw 50 relative to the sleeve 76. By pivoting the handle 52 in a direction to exert a gripping or clamping force on a pipe or other object, the cantilever force on the beam 46 retains the sleeve 76 in position along the beam 46. By pivoting the handle 52 in a direction to release the grip force, the cantilever force of the sleeve 76 on the beam 46 is released, permitting the movable jaw member 48 to be moved along the beam 46 to release the pipe or to accommodate a different size of pipe as desired. For example, the movable jaw member 48 may be slid on the beam 46 to open the jaws to accept a pipe for gripping or may be slid on the beam 46 to close the jaws onto a pipe to be gripped. The sliding movement of the sleeve 76 along the beam 46 provides a course adjustment of the jaw spacing. The rotation of the handle 52 moves the movable jaw 50 by a small distance, providing a fine adjustment of the jaw position. The handle rotation also permits a substantial gripping force to be exerted on the pipe or other object as a result of the combination of the cam in the movable jaw member and the lever action of the handle 52. Adjustments in jaw position of greater than the small distance that is provided by the handle movement are made by sliding the movable jaw member 48 along the beam 46.

Two holes 70 are provided in the base, one on either side of the fixed jaw 44. The holes 70 are shaped to receive the beam 46 in either position on one side or the other side of the fixed jaw 44. The beam 46 can be moved to either hole 70 as desired. Access to the clamp from either side is thereby provided, as desired by the user. The beam 46 is generally of an I-beam shape, and the holes 70 have a corresponding I shape. A fastener, such as screw or bolt or other fastener (not shown) such as may be provided on an underside of the base and extending into the beam 46, may be provided to secure the beam 46 in the respective hole 70.

The release 56 of the first embodiment includes a lever that extends at least part of the way along an underside of the handle 52. The release 56 may include a spring or other biasing means that urges the release lever 56 to an engaged position wherein the release lever 56 extends below the handle 52. The release lever 56 may be pivoted toward the handle 52 for example by squeezing the handle 52 and release lever 56 together so as to overcome the spring force. This releases the engagement of the catch mechanism 54 so that the handle 52 may be moved, for example in the arrow 53 direction. For example, a user may apply a gripping force on a pipe by pressing down on the handle 52 and may release the gripping force on the pipe by squeezing the release lever toward the handle 52 to disengage the catch mechanism 54. The catch mechanism 54 may include a toothed or notched portion that is engaged to secure the handle 52 in a desired rotational position.

Figure 4:
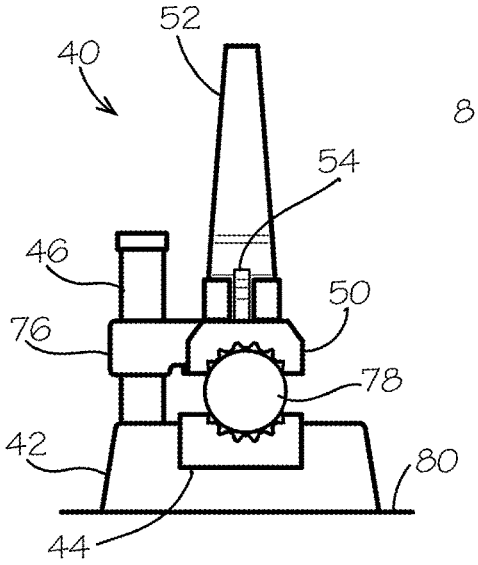
FIG. 4 is a front elevational view of jaw portions of the quick clamp pipe clamp.

In FIG. 4 the base 42 includes the fixed jaw 44 and supports the beam 46 on which is mounted the sleeve 76. The sleeve 76 has sufficient longitudinal extent along the beam 46 to grip the beam 46 when the cantilever force or rotation force is applied by gripping an object between the jaws 44 and 50. A pipe or cylinder 78 is shown gripped between the jaws 44 and 50. The catch mechanism 54 is mounted on the movable jaw 50. The base 42 is on a surface 80 such as a tripod, stand, workbench or truck bed and may be fastened in place on the surface 80. The sleeve 76 may be slid along the beam 46 to accommodate smaller or larger pipes or cylinders 78 when the gripping force by the jaws 44 and 50 is released. Access to the jaws 44 and 50 is available from the right-hand side with respect to FIG. 4, since the beam 46 blocks access from the left-hand side. The user may change the access direction in certain embodiments.

Figure 5:
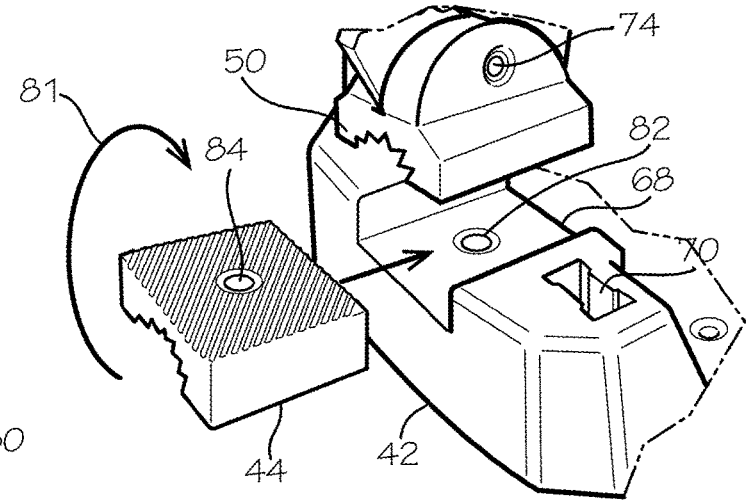
FIG. 5 is a partial perspective view showing a reversible jaw in the quick clamp pipe clamp.

With reference to FIG. 5, the fixed jaw 44 as shown in FIGS. 3 and 4 may be removed from the recess 68 in the base 42 and inverted, as indicated by an arrow 81, to provide a jaw of a different shape. In the example, the fixed jaw 44 is a separate block shaped element from the base 42 has a V-notch shaped first surface and a flat second surface, each provided with ribs or grooves. A releasable fastener, such as a bolt or screw or other fastener, secures the fixed jaw 44 with either the first surface or the second surface directed toward the movable jaw 50. The fastener (visible in FIG. 3) extends into a hole 82 in the base 42 and through a hole 84 in the fixed jaw 44. The fixed jaw 44 and movable jaw 50 each may be inverted, repositioned, or exchanged for other jaws as need to grip a variety of different objects or when replacement is needed for reasons of wear or damage. The hole 70 in which the beam 46 may be inserted is shown in this view.

Figure 6:
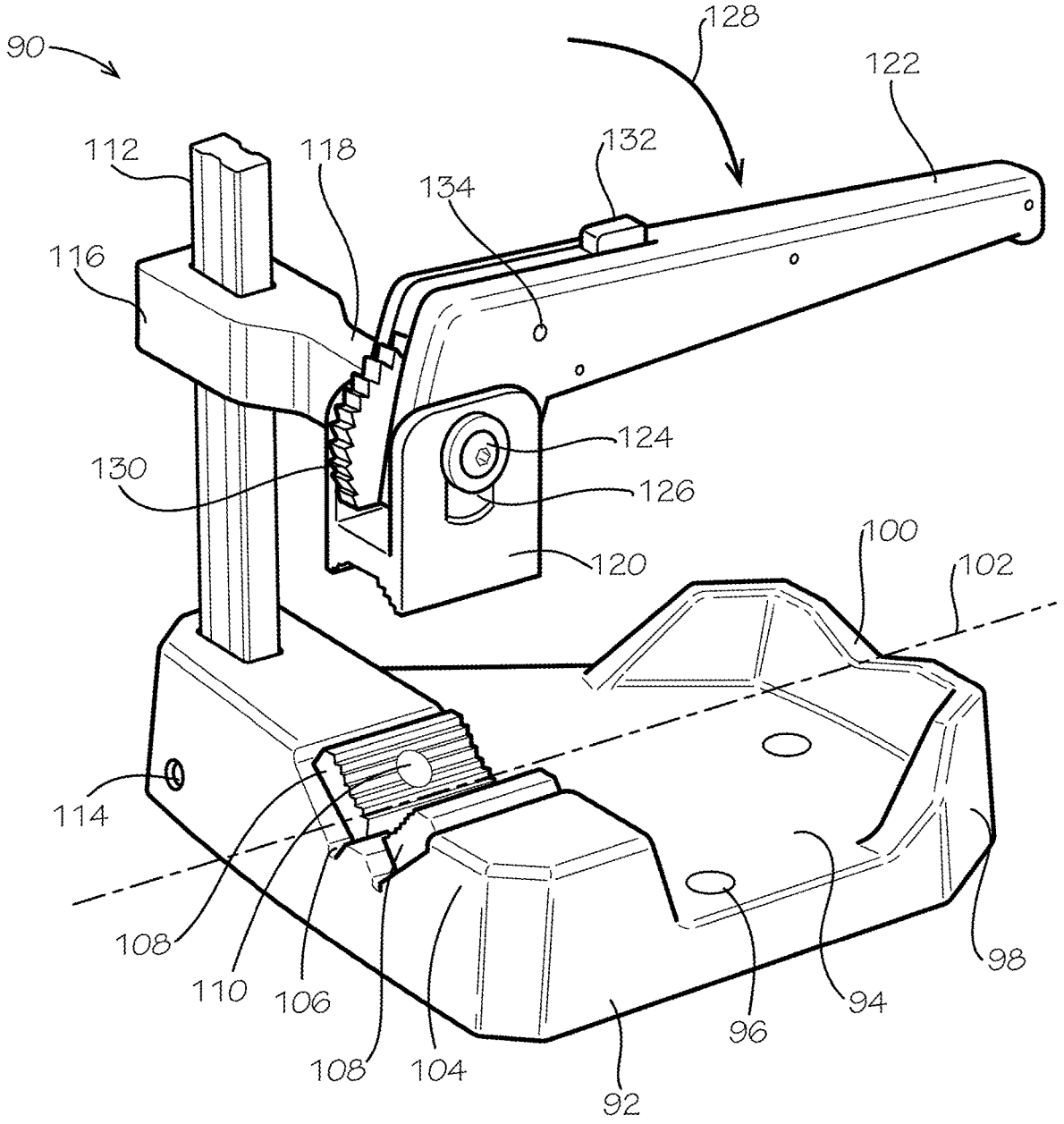
FIG. 6 is a perspective view of a second embodiment of the quick clamp pipe clamp.

Turning now to FIG. 6, a second embodiment of the pipe vise 90 includes a base 92 that has a recessed area 94 in which are provided three holes 96 for securing the base to a surface such as a tripod, stand, workbench or the like. Other numbers and arrangements of holes are of course possible. A raised portion 98 includes a V-shaped notch 100 as a pipe rest that supports extended objects which may lie in a direction indicated by a broken line 102. A raised portion 104 includes a W-shaped recess 106 in which are fastened two jaw pieces 108. The two jaw pieces 108 are secured to angled sides of the W-shaped recess 106 by fasteners such as screws or bolts that extend through openings 110 in the jaw pieces 108 and into the base 92. The jaw pieces 108 are replaceable as needed.

A beam 112 is fastened in an opening in the base 92. An opening 114 is provided in the base 92 for access to a fastener, such as a screw, which may extend from the base to or into the beam 112 and may be used to secure the beam 112 in position. A sleeve 116 is mounted for sliding movement along the beam 112. An arm 118 extends from the sleeve 116. The arm 118 is connected to a movable jaw 120 and a handle 122 by a washer and screw 124. The movable jaw 120 is provided with a slot 126 through which the screw 124 extends. The slot 126 permits the movable jaw 120 to move toward and away from the fixed jaw, which is parallel to the axial direction of the beam 112 in the illustrated embodiment.

The handle 122 pivots about the screw 124 as shown by the arrow 128. The handle 122 may be maintained in a grip force exerting position by a catch mechanism 130 that includes a plurality of teeth formed along an arc-shaped edge. A release button 132 is mounted in the handle 122. The release button 132 pivots about an pivot member 134 in the handle 122 to selectively engage and disengage the catch mechanism 132.

Figure 7:
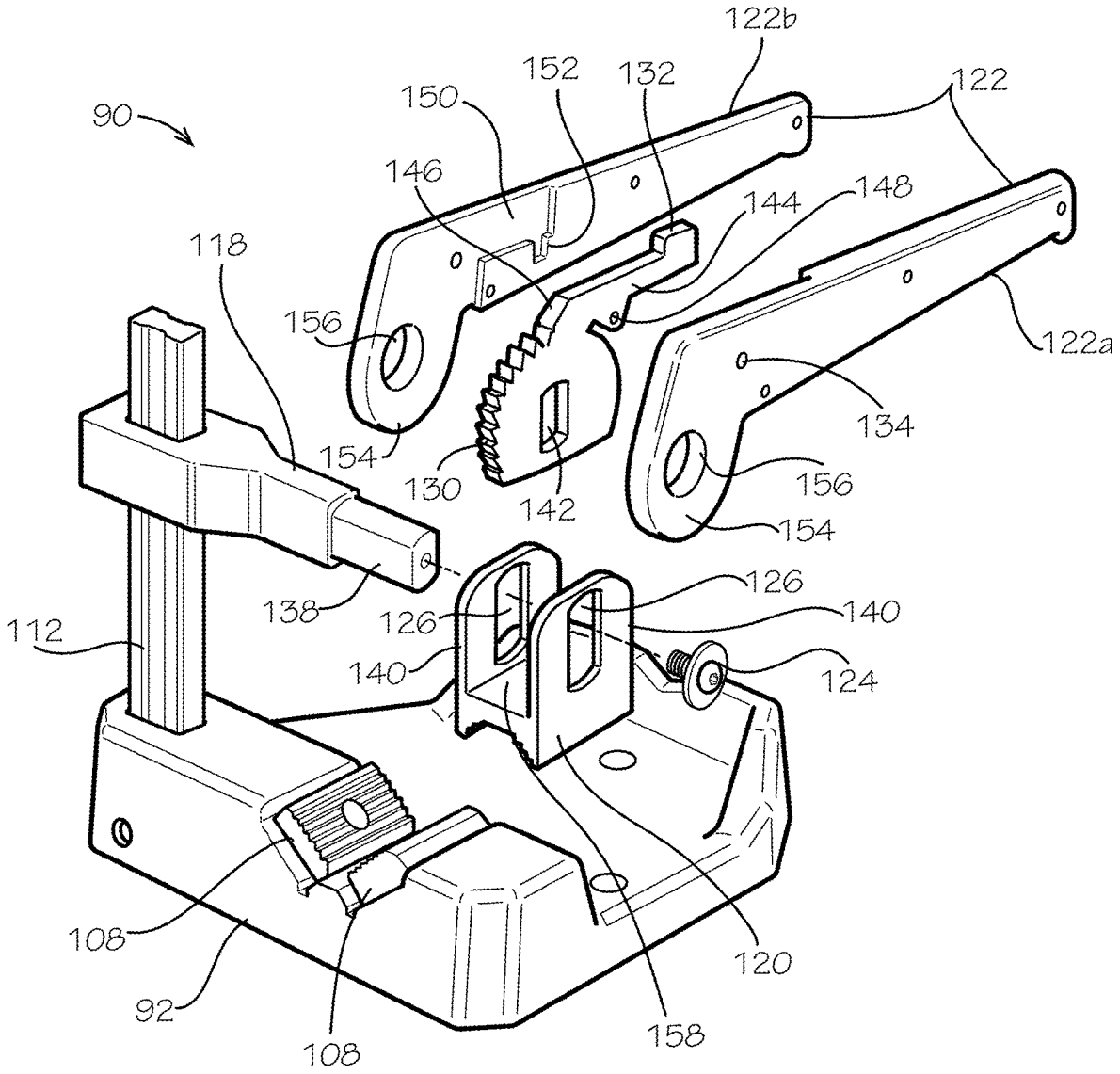
FIG. 7 is an exploded view of the second embodiment.

The pipe vise 90 is shown in FIG. 7 including an exploded view of a movable jaw member 136. The arm 118 includes an extension 138 that is shaped with flat sides and a threaded bore at the end. The movable jaw 120 includes a pair of parallel extensions 140 that are provided with the slots 126 by which the movable jaw 120 may move when mounted on the extension 138. A space is formed between the parallel extensions 140. The movable jaw face extends between the parallel extensions. The catch mechanism 130 is generally half circle-shaped and has an opening 142 that fits onto the extension 138. The release button 132 is at an end of a release lever 144 that has a catch nose 146 at the opposite end that engages the teeth of the catch mechanism 130. The release lever 144 has a pivot opening 148 through which extends the pivot member 134 of the handle 122. The pivot lever 144 is mounted in a recess 150 in the handle 122 that includes a recess extension 152 in which is mounted a spring to bias the pivot lever 144 toward an engaged position with the catch nose 146 engaged in the teeth of the catch mechanism 130.

The handle 122 is formed in two parts 122*a* and 122*b*, between which is mounted the catch mechanism 130 and the release button 132. Each part 122*a* and 122*b* of the handle 122 has an angled extension 154 with an opening 156 that is off-center from the edges of the angled extension to form a cam that bears against a surface of the movable jaw to provide all or part of a clamping apparatus. The opening is circular to permit the handle 122 to rotate on the flattened extension 138. Between the parallel extensions 140 of the movable jaw 120 is a back surface of the movable jaw that serves as a cam follower 158.

Figure 8:
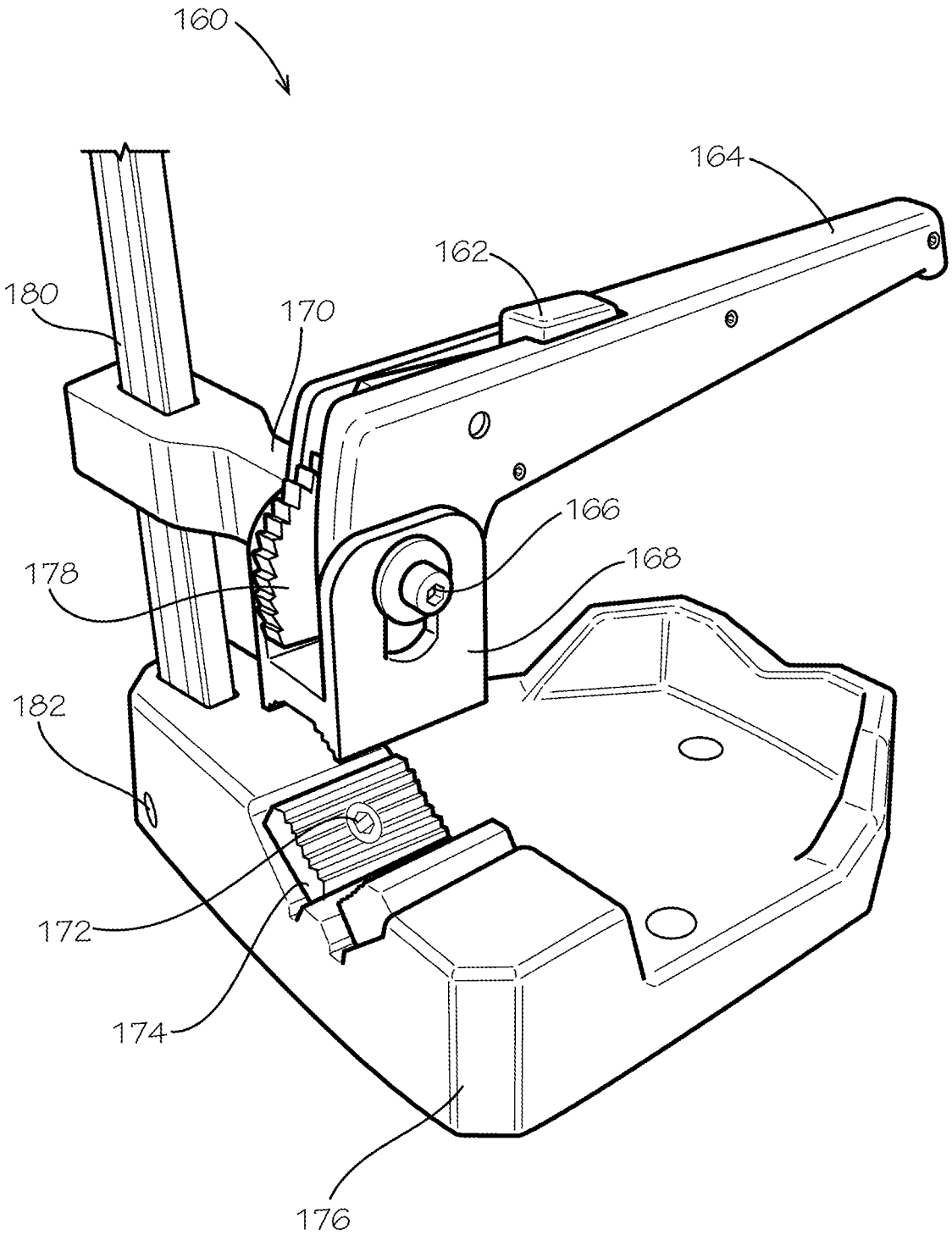
FIG. 8 is a perspective view of a third embodiment of the quick clamp pipe clamp.

FIG. 8 shows an embodiment of the pipe vise 160 similar to the embodiment shown in FIGS. 6 and 7. A difference between the embodiment 90 and the embodiment 160 is that an enlarged release button 162 is provided in a handle 164. Another difference is that an Allen head screw 166 is provided to hold the handle 164 and movable jaw 168 to the arm 170. An Allen head screw 172 holds the fixed jaw 174 to the base 176. A similar screw holds the other fixed jaw 174 to the base 176. The catch mechanism 178 has angled teeth directed in a generally clockwise direction from this view, which engage the catch nose of the release to prevent counter-clockwise rotation of the handle 164, again with respect to this view. The beam 180 is secured in the base 176 by a screw that is accessible through an opening 182.

Figure 9:
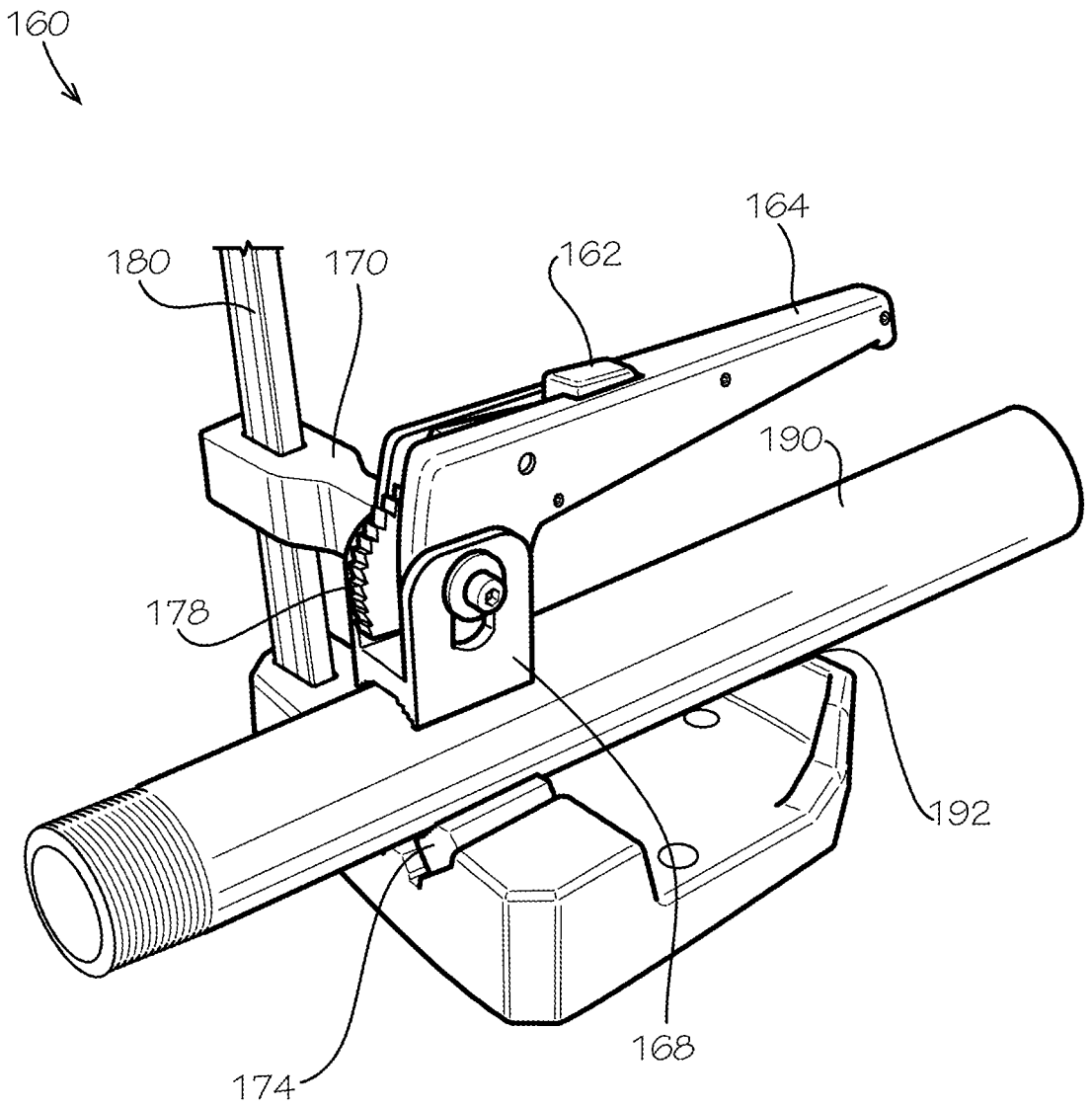
FIG. 9 is a perspective view of the third embodiment shown holding a pipe.

FIG. 9 shows the pipe vise 160 holding a length of pipe 190. The pipe 190 rests in the V-shaped notch or pipe rest 192 of the base and is pressed against the fixed jaws 174 by the movable jaw 168. Prior to being clamped in the vise 190, the arm and sleeve 170 are slid along the beam 180 until the movable jaw 168 is in contact with the pipe 190 or nearly so and the handle 164 is pivoted to a generally upright position. The handle 164 is pivoted clockwise, which presses the movable jaw 168 against the pipe 190 and the pipe 190 against the fixed jaw 174. The catch mechanism 178 holds the handle 164 in the clamping position so that the pipe 190 is clamped in the vise 190. The pipe 190 is released by pressing the release button and rotating the handle to lessen the clamping force, possibly while applying downward force to the handle to permit the catch nose to release from between teeth of the catch mechanism 178.

Figure 10:
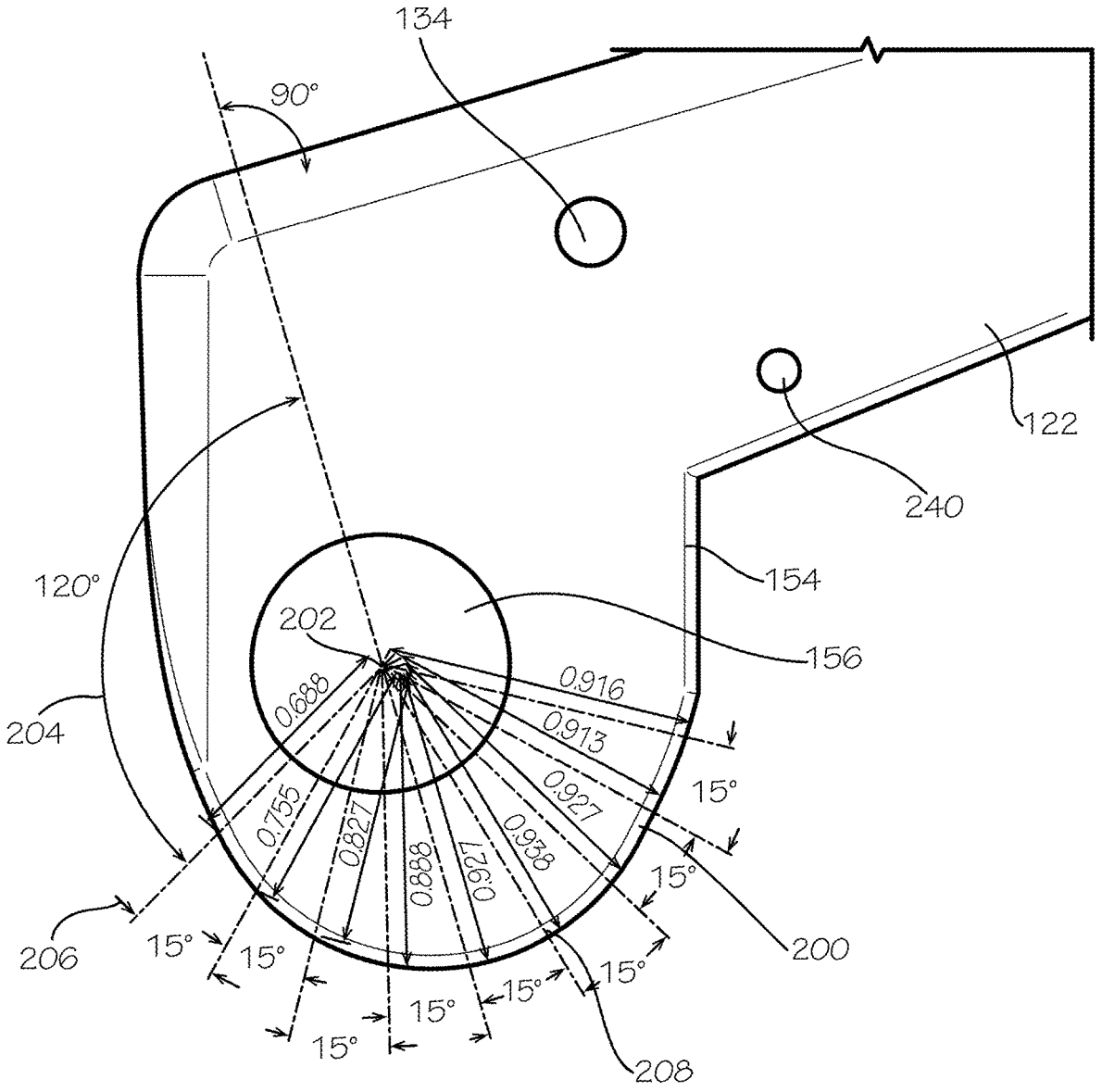
FIG. 10 is a partial side view of a cam portion of the handle of the quick clamp pipe clamp.

The angled extension 154 of the handle 122 is shown in FIG. 10. The extension includes an opening 156 that fits on the extension 138 of the arm 118. The opening 156 is circular in the illustrated embodiment. The angled extension 154 includes a cam surface 200 that presses against the cam follower 158 of the movable jaw 120. The cam surface 200 varies in distance from the center 202 of the opening 156, which is the center of rotation of the handle 122 on the extension 138. In a certain embodiment, the cam surface 200 is configured to begin 120 degrees from a perpendicular to the handle, as shown by arc 204. At the 120 degree position, the cam surface is 0.688 inches from the center 202 of the opening 156. Over the next 15 degrees at 206, the distance from the center 202 to the cam surface 200 increases to 0.755. Over a following 15 degrees, the distance from the center 202 to the cam surface 200 increases to 0.827. In further 15 degree increments, the distances are 0.888; 0.927; 0.938; 0.927; 0.913; and 0.916. The distances of the cam surface 200 from the center 202 thus increase to a maximum value at location 208 and thereafter the distances decrease and at the final segment increase again. The cam surface 200 may therefore provide an over-center type of clamping of the object in the pipe vise 160. Other arrangements and shapes of cam surfaces are of course possible.

In certain embodiments, the handle may be pivoted from a position 60 degrees above horizontal to a position 15 degrees below horizontal. Other ranges of motion are of course possible. In certain embodiments, the pivoting movement of the handle about its range of motion results in a movement of 0.25 inch in the movable jaw.

The pivot opening 134 is shown in the handle 122. An opening 240 is provided for a fastener such as a screw to hold the two parts of the handle 122 to one another.

The sleeve is held in position along the beam by the lever action of the offset forces applied by the vise jaws in certain embodiments. Other embodiments are possible with other means for holding the sleeve on the beam, including embodiments having one or more fasteners, tighteners, ratchets, grippers, channels or other structures.

Figure 11:
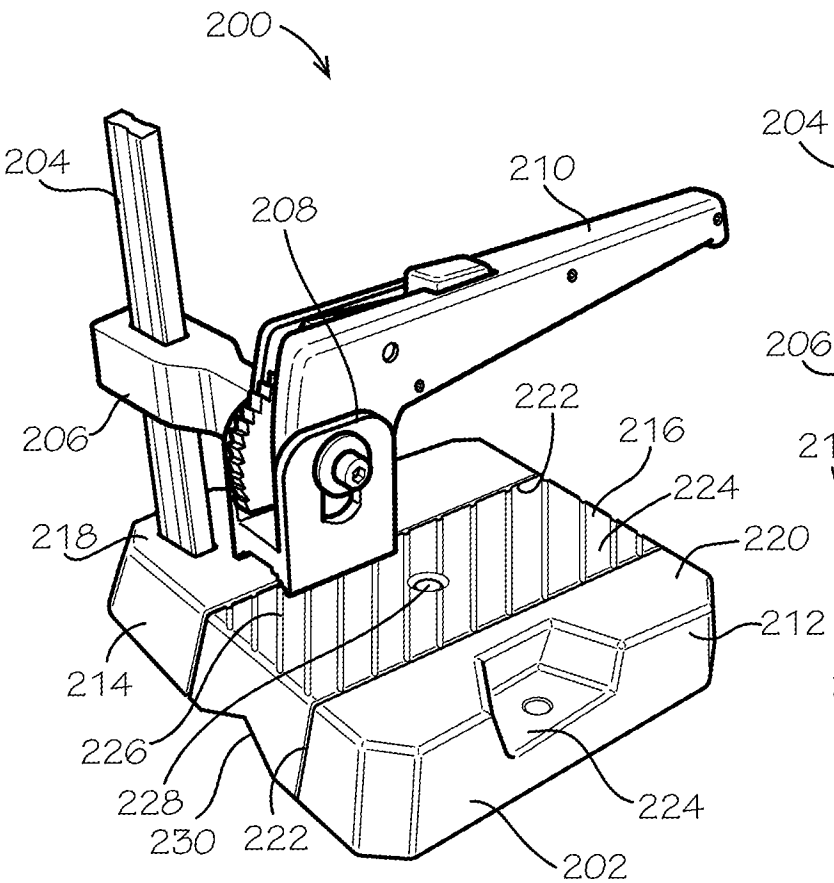
FIG. 11 is a perspective view of a fourth embodiment of the quick clamp pipe clamp in a first configuration.

Turning now to FIG. 11, an embodiment of the pipe vise 200 is shown including a base 202 from which extends a beam 204 and on which is mounted an arm 206 with a movable jaw 208 and a handle 210. The beam 204, arm 206, jaw 208 and handle 210 may be similar or identical to the previously described elements. The base 202 of the illustrated embodiment has first and second side portions 212 and 214 between which is provided a center portion 216. The side portions 212 and 214 are joined to one another as a single piece and may be formed of metal or other durable hard material. The side portions 212 and 214 each have respective top surfaces 218 and 220 that are disposed in a common plane. The side portions 212 and 214 have mutually facing surfaces 222 that are parallel to one another and that define a gap or space between the facing surfaces 222. A recess 224 is provided in each of the side portions 212 and 214 in which is provided a hole for receiving a bolt or other fastener to fasten the base 200 to a support.

The center portion 216 is mounted between the facing surfaces 222 to fill the gap or space between the side portions 212 and 214. The center portion 216 includes a top surface 224 that is co-planar with the top surfaces 218 and 220 of the side portions 212 and 214. The top surface 224 of the center portion 216 includes diagonal grooves 226 at regular intervals which may provide improved grip for objects on the center portion 216. A fastener 228 such as a screw or bolt is in a recess in the center portion 216 where it secures the center portion 216 to the base 202. The fastener 228 is seated in the recess and threads into a bore in the base 202. The center portion 216 may be formed of the same material as the base 202 or may be of a different material, such as a hard rubber. The center portion 216 is positioned beneath the movable jaw 208. Objects being engaged by the movable jaw are pressed against the top surface 224 of the center portion 216. The configuration of FIG. 11 provides the user with a flat surface 224 on the base 202 against which objects to be held by the pipe vise 200 are pressed. The flat surface 224 with the diagonal grooves 226 is but one embodiment that is possible for the center portion 216. Other shapes of top surfaces 224 of the center portion 216 are possible, including one or more raised portions, one or more recessed portions, one or more shaped portions, one or more portions of the different materials, and the like. For example, a shaped top surface may be provided for a specific task or for a specific object to be held, worked, closed, opened, or reshaped.

As will be discussed, a V-shaped notch 230 is provided at an underside of the center portion 216, as is apparent in FIG. 11.

Figure 12:
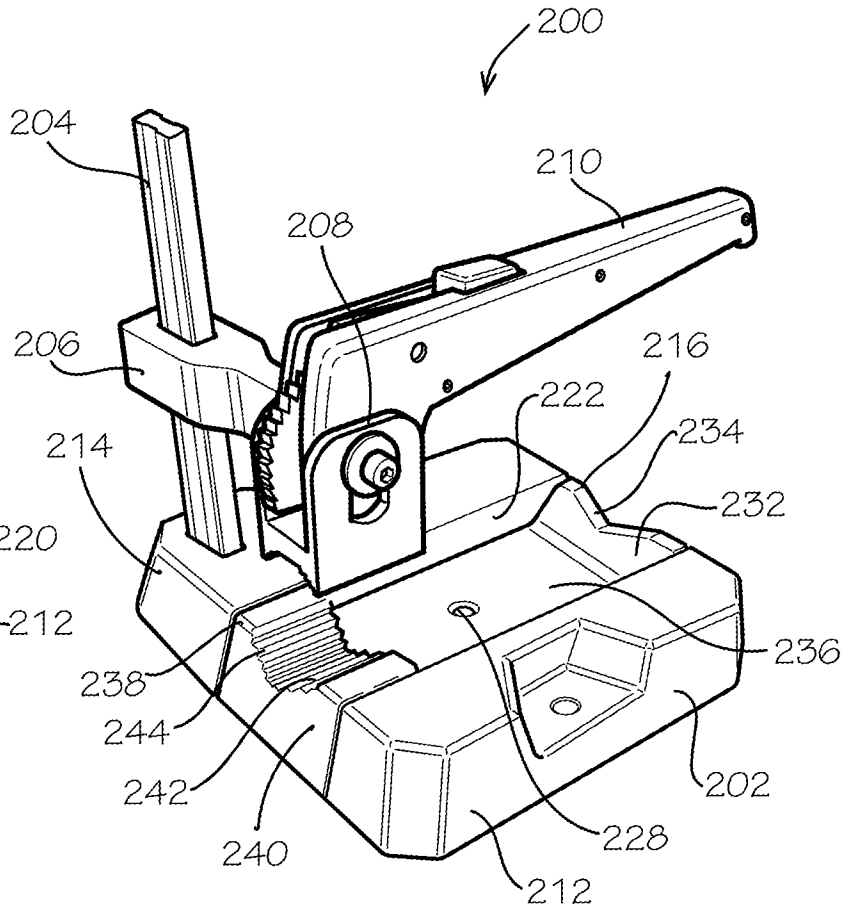
FIG. 12 is a perspective view of the fourth embodiment shown in a second configuration.

Referring to FIG. 12, the pipe vise 200 of FIG. 11 is shown with the center portion 216 in an inverted position in the base 202. Otherwise, all the components of the pipe vise 200 are the same. The center portion 216 includes a first raised end 232 in the shape of a wall having a notch 234 formed by two downwardly angled surfaces at the top of the wall shaped raised end 232. The notch 234 is shaped to receive a pipe or other object being held by the pipe vise 200. The first raised end 232 extends upward from a recessed center portion 236 having a generally planer shape and including an opening for the fastener 228. At the end of the center portion 216 disposed beneath the movable jaw 208 is a stationary jaw 238. The stationary jaw 238 is formed of a thick wall 240 extending upward from the recessed center portion 236. A notch 242 is formed by two angled top surfaces of the thick wall 240. Ridges or serrations 244 are formed into the top surfaces at the notch 242.

A pipe, rod, cylinder, beam, or other object to be gripped by the pipe clamp 200 may be placed in the notch 242 and griped by the movable jaw 208 by pressing the object against the stationary jaw 238. The movable jaw 208 has a notch with ridges in an opposed position to the stationary jaw 238 for gripping round or cylindrical objects, for example. For longer objects to be gripped, the object is supported in the notch 234 at the first raised end of the center portion 216 while being gripped between the movable jaw 208 and the stationary jaw 238. The center portion 216 may be changed between the position with the stationary jaw 238 facing toward the movable jaw 208 or with the flat surface 224 facing toward the movable jaw 208 by removing or releasing the fastener 228, inverting the center portion 216, and reaffixing the fastener 228. The fastener 228 may extend from the opening at the center of the center portion 216 into the base 202, such as by being threaded into a threaded bore in the base 202. Two fasteners 228 of different length may be provided in some embodiments for fastening the center portion 216 in the two positions. For example, a longer screw may be used as the fastener 228 in the position shown in FIG. 11 in order to reach from the center portion 216 to the base 202, whereas a shorter screw may reach in the position shown in FIG. 12 so that a shorter screw may be used as the fastener 228 when fastened in the recessed center portion 236.

Figure 13:
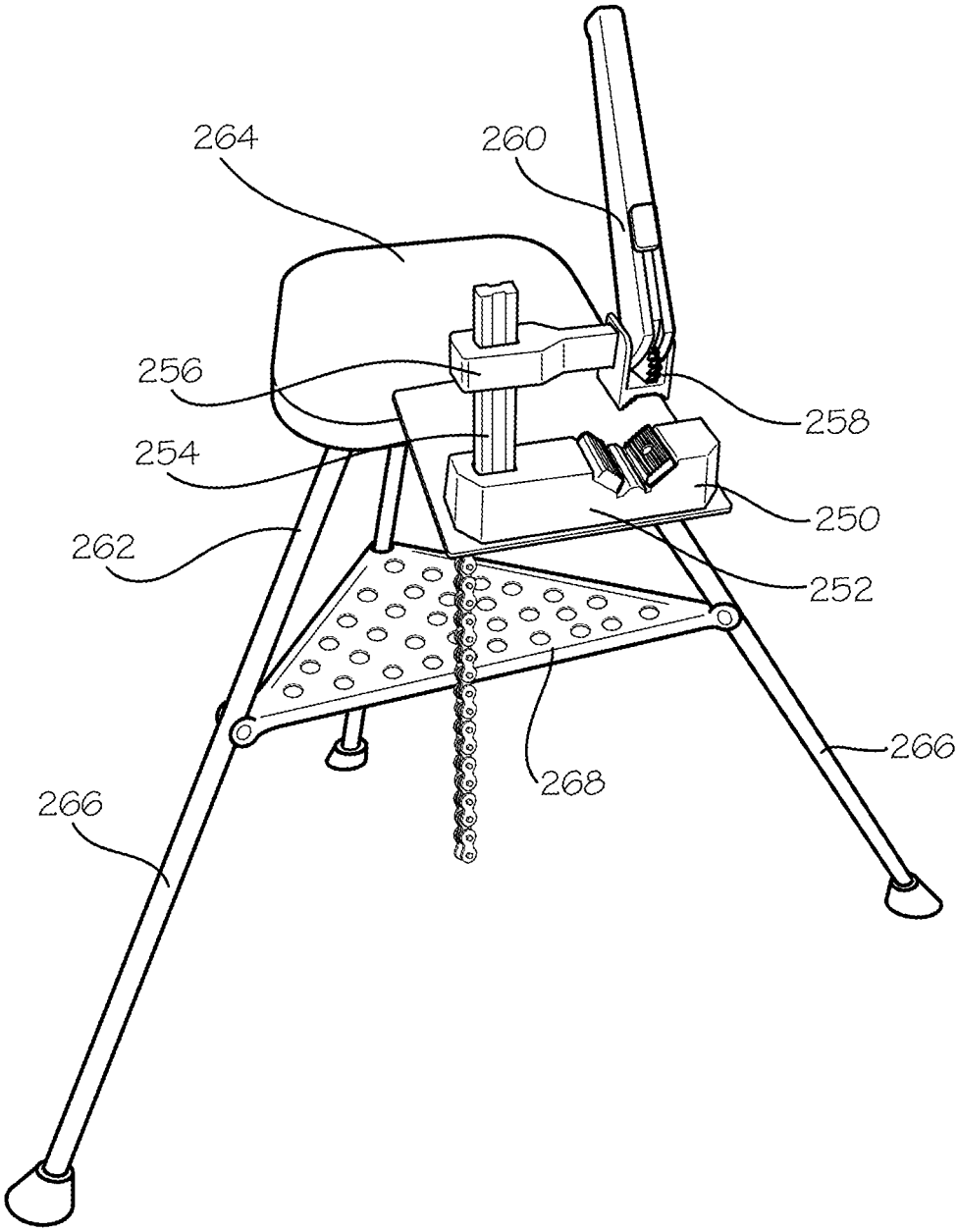
FIG. 13 is a perspective view of the present pipe clamp supported on a tripod.

FIG. 13 shows an embodiment of a pipe vise 250 being used to grip sections of pipe. The pipe vise 250 has a base 252 from which extends a beam 254 on which is mounted an arm 256 at the end of which is a movable jaw 258 and handle 260. The configuration and operation of the pipe vise 250 is similar to the embodiments described herein. The pipe vise 250 is mounted on a tripod 262 having a top plate 264 to which the pipe vise 250 is mounted. Three legs 266 extend from the underside of the top plate 264 to support the top plate 264 and pipe vise 250 on a surface, such on a floor of a work shop. The tripod legs 266 are attached to a spreader 268 that braces the legs 266 and also provides a tray on which tools, pipe fittings, scrap pieces of pipe, and other objects may be placed. The need to have room around the pipe vise 250 for moving sections of pipe, for example, about during bending and shaping of the pipe, assembly of pipe sections, and for free movement of workers around the pipe or other object as the object is being worked, requires an area free of work benches, tables, tool boxes, and the like where tools and other objects may be placed. Placement of pipe, tools and other objects on the floor is not an option for safety reasons. The spreader tray 268 becomes a catch-all for tools and objects. However, the spreader tray 268 is of limited size and capacity.

Figure 14:
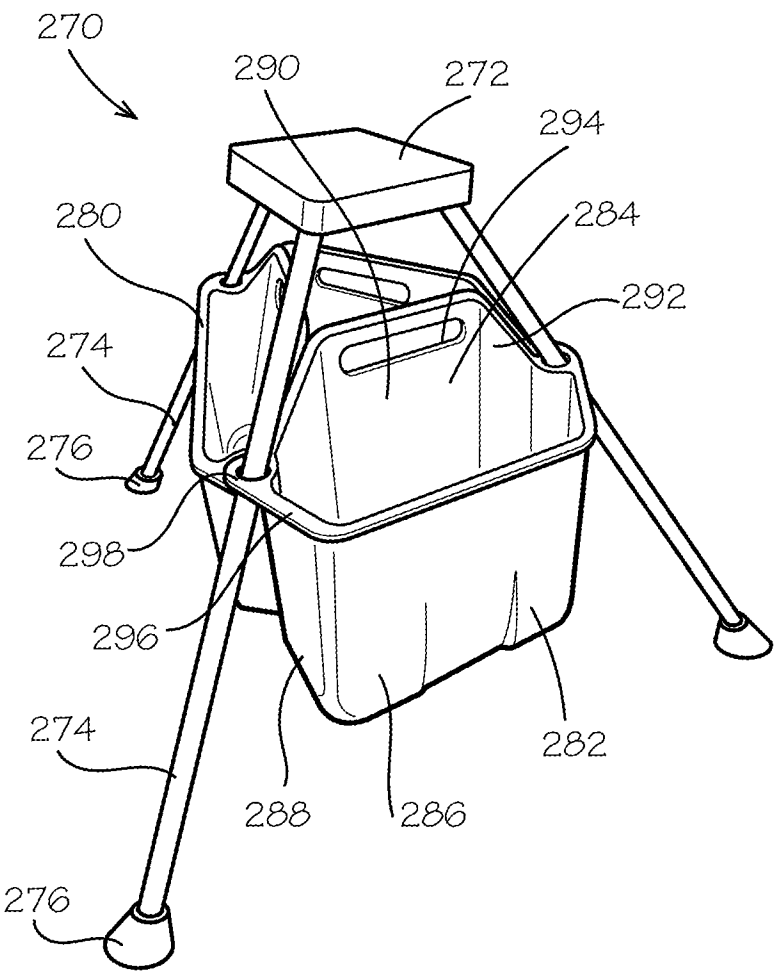
FIG. 14 is a perspective view of a first embodiment of a tripod for supporting a pipe clamp.

FIG. 14 shows a first embodiment of a tripod 270 for use with any of the embodiments of the pipe vise. The tripod 270 includes a top plate 272 of a generally rectangular shape. The top plate 272 is configured for attaching the base of the pipe vise to the top surface of the top plate 272, such as by bolts, screws, or other fasteners. The tripod has three legs 274 that are attached at the underside of the top plate 272 and that extend outwardly to provide a wide stance for stability. Each leg 274 includes a foot 276 that is configured to rest on a floor. The top plate 272 and legs 274 may be formed of metal, such as steel, and the feet 276 may be formed of rubber or plastic, although other materials are of course possible.

A spreader 278 is formed of three bins 280 as a tray replacement. Each bin 280 has a front wall 282 that extends outward from the legs 274, and a rear wall 284 that extends inward from the legs 274. The front wall 282 may have a flat front wall 286 and right angle front sides 288. The rear wall 284 has a flat rear wall 290 and tapered or angled sides 292. The tapered or angled sides are shaped to extend generally parallel with corresponding angled or tapered sides of adjoining bins 280, enabling the bins 280 to fit together within the tripod legs. The flat rear wall has a handle opening 294 near a top edge. Each bin 280 has a bottom, not visible in this view. At opposite sides of the bins 280 are flanges 296 through which are formed leg openings 298. The legs 274 each extend through two of the leg openings 298 of adjacent bins 280. The flanges 296 overlap where each leg 274 extends through two of the leg openings 298. The bins 280 may be supported solely by the legs 274 extending through the openings 298, or the bins 280 may be supported by additional support means, such as fasteners connected between the legs and bins or by rings secured on the legs, or other support means.

The bins 280 may extend from just below the top plate 272 to the floor, or may be of a shallower depth as desired. The bins 280 provide a substantially greater holding and storage space than the spreader tray of prior tripods. The bins 280 have a slight taper to the vertical walls to permit stacking of the bins 280 within one another when removed from the tripod. The handle openings 294 permit the bins 280 to be carried, for example with supplies to be used with the pipe vise or with debris or tools from use of the pipe vise.

Figure 15:
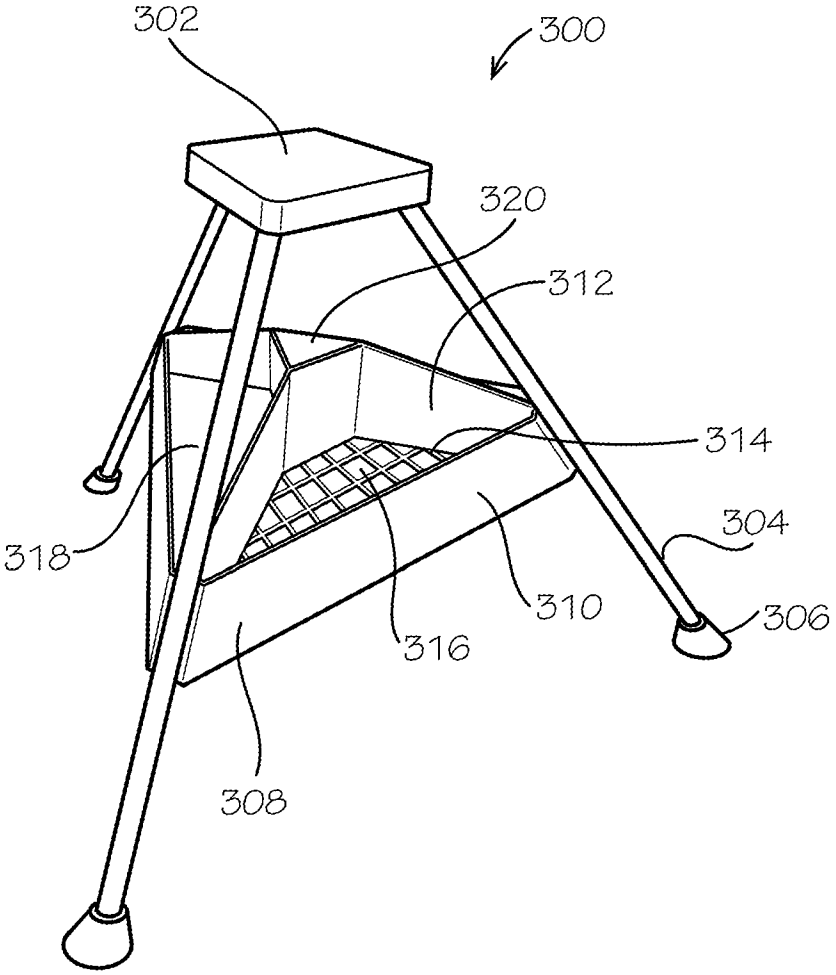
FIG. 15 is a perspective view of a second embodiment of a tripod for supporting a pipe clamp.

In FIG. 15 is shown another embodiment of a tripod 300 for use with the pipe vise. Like the tripod of FIG. 14. the tripod 300 has a top plate 302 from which extends three legs 304, on the end of which are feet 306. The legs 304 are attached to a spreader 308 that is generally triangular in shape. The spreader 308 provides a tray on which to place items such as tools, pipe, and pipe fittings. The spreader 308 includes tall sidewalls 310 enclosing a storage area. Divider walls 312 are provided within the storage area. The divider wall 312 of the illustrated embodiment provide three storage areas.

In a first storage area 314, a bottom surface 316 is formed of a large grating formed of crossed bars. Small objects, such as metal filings, shavings from thread cutting, dirt, debris, rust, or other small items, may fall through the large grating bottom 316. The storage area 314 may provide storage for pipes, for example, which may have been placed into the storage area with debris within or on the pipe, for example. Dirt, debris, metal shavings, and the like do not accumulate in the storage area, as the grate has openings large enough for small objects to fall through but small enough to retain lengths of pipe, for example. Other openings may be provided in place of the grate formed of cross bars.

A second storage area has a solid bottom 318 so that small objects like screws and nuts for pipe fittings will not fall out of the storage area. A third storage area is provided behind the divider walls 312 in this view and may have either a solid bottom, an open grating bottom, or other type of bottom such as having openings to hold tools or having another shape. The divider walls 312 provide three storage areas and define a central area 320 which may provide additional storage or may be open at the bottom.

The spreader 308 not only provides a larger storage area than the prior spreader tray, but also provides separate storage areas and provides at least one storage area that permits dirt, debris, metal filings, and metal shavings from thread cutting and the like to drop through the openings in the storage area so as not to accumulate in the storage area.

The tripods may be provided with the pipe vise or may be provided separately.

The materials used in the pipe vise may include steel or other formed or case metals. The jaws may be of harder or softer material as desired, and may include steel, aluminum, rubber or plastic jaws, depending on usage. The jaws facings may be formed of different materials than the rest of the jaw. Other materials are of course possible.

The present application discloses various aspects of the method and apparatus.

In a first aspect, clamp, comprising: a base; a fixed jaw mounted in the base; a beam extending from the base; a movable jaw body mounted on the beam, the movable jaw body including: a movable jaw, a pivotable handle, a clamping apparatus connected between the movable jaw and the pivotable handle and constructed and operable to move the movable jaw relative to the fixed jaw, and a latch constructed and operable to hold the pivotable handle in a clamping position.

In a second aspect, a clamp of the first aspect, further comprising: a tripod affixed to the base, the tripod including three legs arranged to support the base on a surface; a spreader extending between the legs, the spreader including a plurality of compartments configured for receiving objects.

In a third aspect, a clamp of the second aspect, wherein the spreader include three bins, the bins each having front, back, and side walls and a bottom and having flanges extending from the side walls, the flanges defining leg openings through which extend the legs of the tripod, the flanges of adjacent bins being in overlapping relation, the bins being removable from the tripod, the bins being separatable from on another when removed from the tripod.

In a fourth aspect, a clamp of the second aspect, wherein the spreader includes a first compartment having a bottom with openings, the spreader including a second compartment with a solid bottom.

In a fifth aspect, a clamp of the first aspect, wherein the fixed jaw includes a V-shaped notch in the base.

In a sixth aspect, a clamp of the fifth aspect, wherein the fixed jaw is configured to be removable from the base, the fixed jaw having a first side with the V-shaped notch and a second opposite side with a planar face, the fixed jaw being selectively mountable in the base with either the first side or the second side directed toward the movable jaw.

In a seventh aspect, a clamp of the sixth aspect, wherein the removable fixed jaw includes a recessed portion and a raised portion with a notch on the first side, the raised portion with the notch being aligned with the V-shaped notch of the fixed jaw, the removable fixed jaw having the second opposite side with an extended planar face disposed beneath the handle.

In an eighth aspect, a clamp of the fifth aspect, wherein the fixed jaw includes first and second removable jaw pieces mounted at an angle to one another in the base.

In a ninth aspect, a clamp of the first aspect, wherein the latch is configured to provide a plurality of latching positions corresponding to a plurality of clamping positions of the movable jaw.

In a tenth aspect, a clamp of the ninth as claimed in claim 9, wherein the latch includes a button mounted in the handle, the button being operable to pivot catch between an engaged position and a disengaged position with at least one of a plurality of teeth.

In an eleventh aspect, a clamp of the ninth aspect, wherein the latch includes a release lever disposed along the handle and operable by squeezing the release lever toward the handle.

In a twelfth aspect, a clamp of the first aspect, wherein the clamping apparatus includes a cam operably connecting the handle and the movable jaw, the cam being configured to move the movable jaw to different positions as the handle is moved to different positions.

In a thirteenth aspect, a clamp of the twelfth aspect, wherein the clamping apparatus includes an over-center clamping position.

In a fourteenth aspect, a clamp of the first aspect, wherein the movable jaw body includes a sleeve and an arm, the sleeve being selectively slidable along the beam when clamping force is released by the clamping apparatus, the arm extending between the sleeve and the movable jaw to exert a cantilever force by the sleeve on the beam when clamping force is exerted by the movable jaw.

In a fifteenth aspect, a method for clamping an object, comprising: positioning the object on a fixed jaw mounted in a base; sliding a movable jaw member along a beam to a position wherein a movable jaw is at or near the object; rotating a handle on the movable jaw member to a clamping position wherein the movable jaw exerts a clamping force to clamp the object between the movable jaw and the fixed jaw; and latching the handle in the clamping position to maintain the clamping force by the movable jaw.

In a sixteenth aspect, a method of the fifteenth aspect, further comprising: clamping a first object against a first side of the fixed jaw; inverting the fixed jaw between the first side and a second side; and clamping a second object against the second side of the fixed jaw.

In a seventeenth aspect, a method of the fifteenth aspect, wherein the latching includes: latching the handle in a first position to exert a first latching force; and latching the handle in a second position to exert a second latching force.

In an eighteenth aspect, a method of the fifteenth aspect, wherein the latching includes: moving the handle to an over-center latched position.

In a nineteenth aspect, a method of the fifteenth aspect, further comprising: releasing a latch; rotating the handle from the latching position after the latch is released; and removing the object from between the fixed jaw and the movable jaw.

In a twentieth aspect, a method of the fifteenth aspect, further comprising: disconnecting the beam from a first position on the base; reconnecting the beam at a second position on the base; and clamping an object between the fixed jaw and the movable jaw with the beam in the second position.

Although other modifications and changes may be suggested by those skilled in the art, it is the intention of the inventors to embody within the patent warranted hereon all changes and modifications as reasonably and properly come within the scope of their contribution to the art.

We claim:

1. A clamp, comprising:
- a base;
- a fixed jaw mounted in the base;
- a beam extending from the base;
- a movable jaw body mounted on the beam, the movable jaw body including:
  - a movable jaw,
  - a pivotable handle,
  - a clamping apparatus connected between the movable jaw and the pivotable handle and constructed and operable to move the movable jaw relative to the fixed jaw, and
  - a latch constructed and operable to hold the pivotable handle in a clamping position.

2. A clamp as claimed in claim 1, further comprising:
- a tripod affixed to the base, the tripod including
  - three legs arranged to support the base on a surface;
  - a spreader extending between the legs, the spreader including a plurality of compartments configured for receiving objects.

3. A clamp as claimed in claim 2, wherein the spreader include three bins, the bins each having front, back, and side walls and a bottom and having flanges extending from the side walls, the flanges defining leg openings through which extend the legs of the tripod, the flanges of adjacent bins being in overlapping relation, the bins being removable from the tripod, the bins being separatable from on another when removed from the tripod.

4. A clamp as claimed in claim 2, wherein the spreader includes a first compartment having a bottom with openings, the spreader including a second compartment with a solid bottom.

5. A clamp as claimed in claim 1, wherein the fixed jaw includes a V-shaped notch in the base.

6. A clamp as claimed in claim 5, wherein the fixed jaw is configured to be removable from the base, the fixed jaw having a first side with the V-shaped notch and a second opposite side with a planar face, the fixed jaw being selectively mountable in the base with either the first side or the second side directed toward the movable jaw.

7. A clamp as claimed in claim 6, wherein the removable fixed jaw includes a recessed portion and a raised portion with a notch on the first side, the raised portion with the notch being aligned with the V-shaped notch of the fixed jaw, the removable fixed jaw having the second opposite side with an extended planar face disposed beneath the handle.

8. A clamp as claimed in claim 5, wherein the fixed jaw includes first and second removable jaw pieces mounted at an angle to one another in the base.

9. A clamp as claimed in claim 1, wherein the latch is configured to provide a plurality of latching positions corresponding to a plurality of clamping positions of the movable jaw.

10. A clamp as claimed in claim 9, wherein the latch includes a button mounted in the handle, the button being operable to pivot catch between an engaged position and a disengaged position with at least one of a plurality of teeth.

11. A clamp as claimed in claim 9, wherein the latch includes a release lever disposed along the handle and operable by squeezing the release lever toward the handle.

12. A clamp as claimed in claim 1, wherein the clamping apparatus includes a cam operably connecting the handle and the movable jaw, the cam being configured to move the movable jaw to different positions as the handle is moved to different positions.

13. A clamp as claimed in claim 12, wherein the clamping apparatus includes an over-center clamping position.

14. A clamp as claimed in claim 1, wherein the movable jaw body includes a sleeve and an arm, the sleeve being selectively slidable along the beam when clamping force is released by the clamping apparatus, the arm extending between the sleeve and the movable jaw to exert a cantilever force by the sleeve on the beam when clamping force is exerted by the movable jaw.

15. A method for clamping an object, comprising:
- positioning the object on a fixed jaw mounted in a base;
- sliding a movable jaw member along a beam to a position wherein a movable jaw is at or near the object;
- rotating a handle on the movable jaw member to a clamping position wherein the movable jaw exerts a clamping force to clamp the object between the movable jaw and the fixed jaw; and
- latching the handle in the clamping position to maintain the clamping force by the movable jaw.

16. A method as claimed in claim 15, further comprising:
- clamping a first object against a first side of the fixed jaw;
- inverting the fixed jaw between the first side and a second side; and
- clamping a second object against the second side of the fixed jaw.

17. A method as claimed in claim 15, wherein the latching includes:
- latching the handle in a first position to exert a first latching force; and
- latching the handle in a second position to exert a second latching force.

18. A method as claimed in claim 15, wherein the latching includes:
- moving the handle to an over-center latched position.

19. A method as claimed in claim 15, further comprising:
- releasing a latch;
- rotating the handle from the latching position after the latch is released; and
- removing the object from between the fixed jaw and the movable jaw.

20. A method as claimed in claim 15, further comprising:

disconnecting the beam from a first position on the base;

reconnecting the beam at a second position on the base; and clamping an object between the fixed jaw and the movable jaw with the beam in the second position.

* * * * *